United States Patent [19]

Yamada et al.

[11] Patent Number: 4,736,879

[45] Date of Patent: Apr. 12, 1988

[54] PNEUMATIC TOOL WITH PRESSURE INTENSIFIER

[75] Inventors: Toshio Yamada; Mitsuhiro Takatsuru; Keiziro Murayama, all of Tokyo, Japan

[73] Assignee: Max Company Limited, Tokyo, Japan

[21] Appl. No.: 566,179

[22] Filed: Dec. 28, 1983

[51] Int. Cl.[4] ..... B25C 1/04; B27F 7/09

[52] U.S. Cl. ..... 227/130; 417/225; 417/264

[58] Field of Search ..... 227/130, 156; 417/46, 417/349, 264, 225; 91/422

[56] References Cited

U.S. PATENT DOCUMENTS

| | | | |
|---|---|---|---|
| 2,532,679 | 12/1950 | Slater | 417/225 |
| 2,652,780 | 9/1953 | Adams | 417/225 |
| 2,780,171 | 2/1957 | Heddy | 417/264 X |
| 3,253,775 | 5/1966 | Jackson | 417/264 |
| 3,632,230 | 1/1972 | Ueda | 417/349 X |
| 3,858,780 | 1/1975 | Perkins et al. | 227/130 X |
| 3,967,538 | 7/1976 | Thomas | 91/422 X |
| 4,213,301 | 6/1980 | Maier et al. | 91/170 R X |
| 4,523,895 | 6/1985 | Silva | 417/225 |

*Primary Examiner*—Mark Rosenbaum
*Assistant Examiner*—Taylor J. Ross
*Attorney, Agent, or Firm*—A. Thomas S. Safford

[57] ABSTRACT

A pressure intensifier is automatically driven repeatedly by compressed air from a compressed air source to produce highly compressed air for storage in a pressure chamber. The pressure chamber is selectively connected to or disconnected from a drive cylinder having housed therein a drive piston, under the control of a valve mechanism provided therebetween. By the actuation of the valve mechanism the highly compressed air stored in the pressure chamber is introduced into the drive cylinder to propel the drive piston, driving a nail or like fastening element into a hard receiving material such as concrete.

5 Claims, 10 Drawing Sheets

FIG. 9
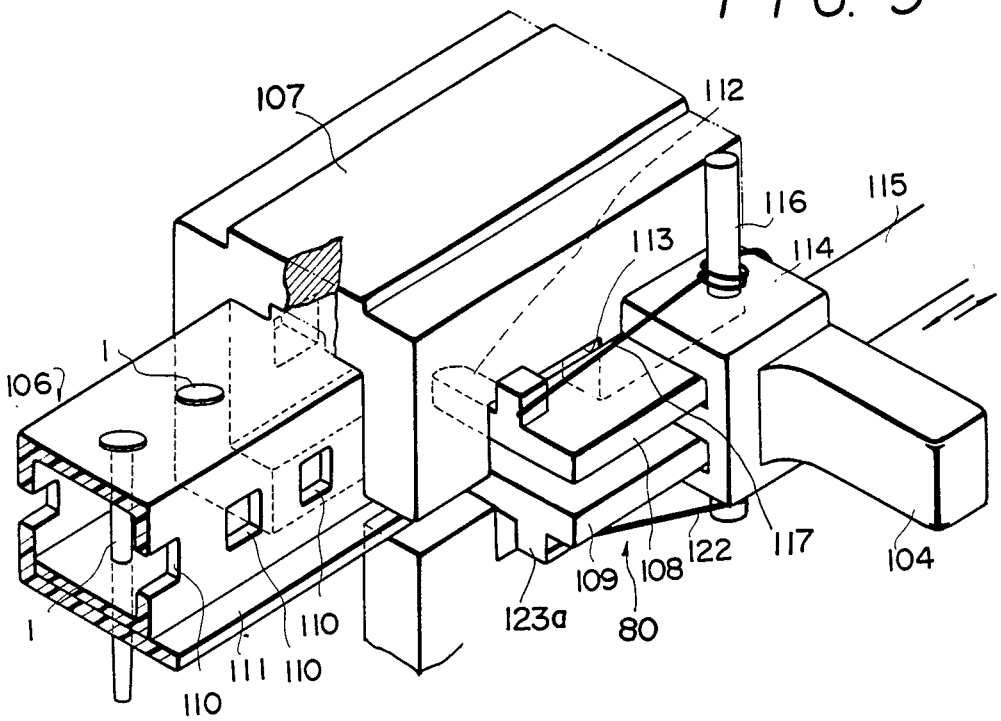
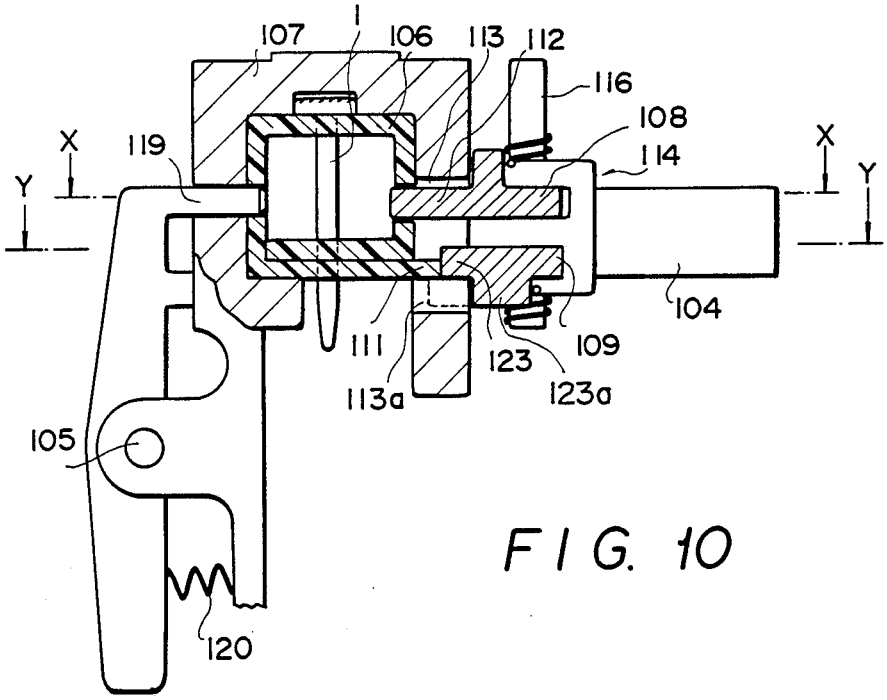
FIG. 10

PNEUMATIC TOOL WITH PRESSURE INTENSIFIER

BACKGROUND OF THE INVENTION

1. Field of the Invention

The present invention relates to a pneumatic tool which is provided with a pressure intensifier or transducer for further pressurizing compressed air supplied from a compressed air source and a driving piston which is driven by the highly compressed air to insert nails, rivets or like fastening elements into hard receiving materials, such as concrete or steel.

2. Description of the Prior Art

There has been known a pneumatic tool of the type in which compressed air from a compressed air source is used to propel a driving piston which in turn drives a nail, rivet or the like in a receiving material. Recently there has been proposed a pneumatic tool which is provided with a pressure intensifier for raising the pressure of the compressed air to a secondary pressure for propelling the driving piston. See U.S. Pat. No. 4,213,301, issued July 22, 1980 to Maier et al.

According to this pneumatic tool, however, the pressure intensifier directly converts the atmospheric pressure to the secondary one through utilization of the compressed air pressure from the compressed air source and, in addition, the highly compressed air for one drive stroke of the driving piston is produced by only one operation of the pressure intensifier. Accordingly, the pressure intensifier inevitably becomes bulky and is very troublesome to handle. Further, this pneumatic tool, though operated by highly compressed air, has a disadvantage regarding safety.

SUMMARY OF THE INVENTION

It is therefore an object of the present invention to provide a pneumatic tool which is provided with a pressure intensifier which is small in size but always produces highly compressed air to ensure each fastening element driving operation.

Another object of the present invention is to provide a pneumatic tool which is provided with a pressure intensifier for raising the pressure of compressed air from an air source to a secondary pressure.

Another object of the present invention is to provide a pneumatic tool which is provided with a pressure intensifier of improved pressure intensifying efficiency.

Another object of the present invention is to provide a pneumatic tool which is provided with a control mechanism for controlling the operation of a pressure intensifier so that the pressure converted by the pressure intensifier may not exceed a predetermined value.

Another object of the present invention is to provide a pneumatic tool which is provided with a relief valve for discharging therethrough highly compressed air to the outside of the tool after each fastening element driving work.

Another object of the present invention is to provide a pneumatic tool which is capable of preventing a so-called contact shooting which is carried out by merely contacting a muzzle part of the tool with a receiving material, with a trigger lever pulled to its operative position in advance.

Yet another object of the present invention is to provide a pneumatic tool which is capable of safety driving of fastening elements into a receiving material without blank shooting.

BRIEF DESCRIPTION OF THE DRAWINGS

FIG. 9 is a perspective view of a fastening element supply mechanism identified by P7 in FIG. 1;

FIG. 10 is a front view of the fastening element supply mechanism; and

DESCRIPTION OF THE PREFERRED EMBODIMENTS

Figure 1:
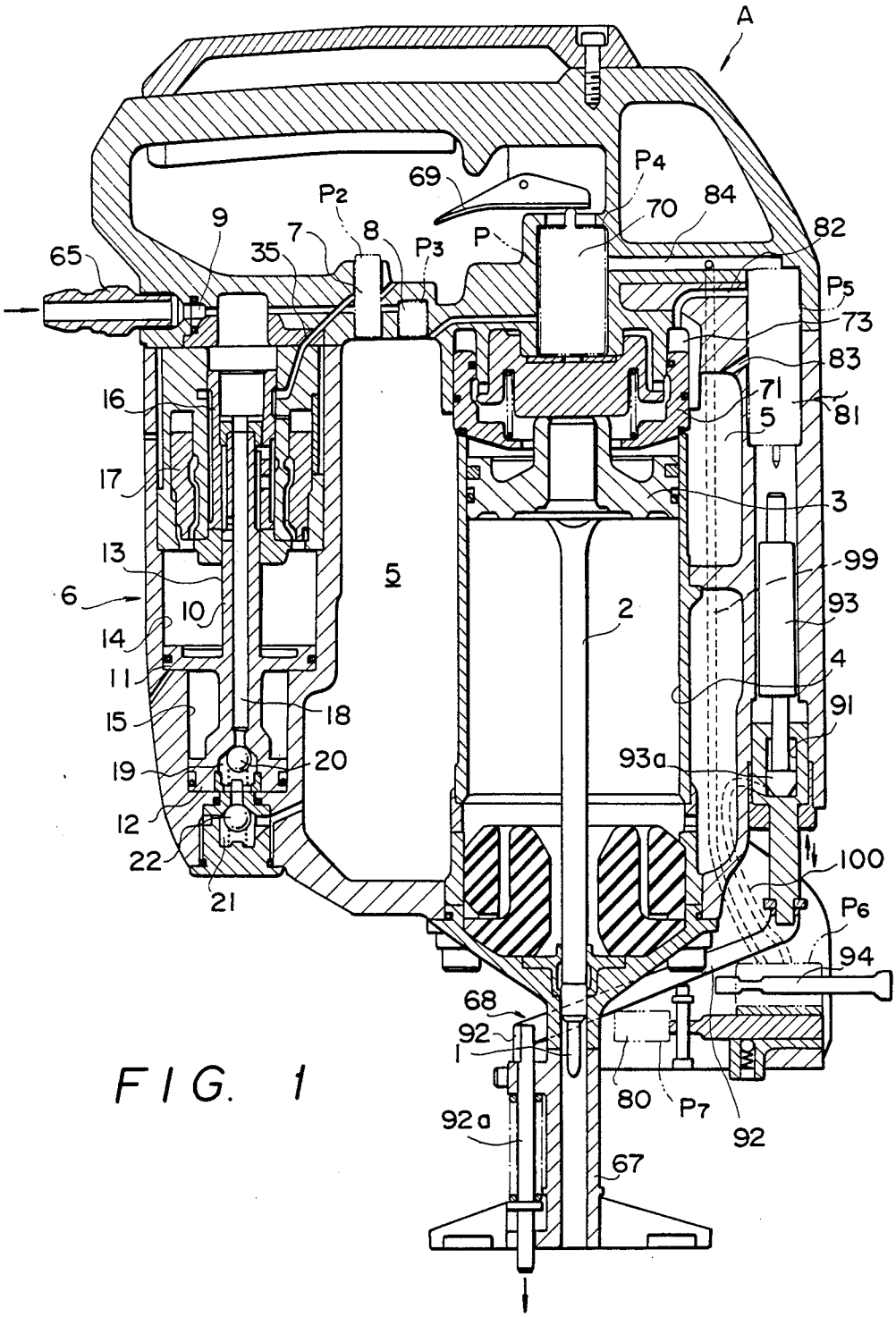
FIG. 1 is a longitudinal sectional view showing the outline of an example of the pneumatic tool embodying the present invention.

In the drawings, reference character A indicates generally a pneumatic tool of the present invention. The pneumatic tool A comprises a driving piston 3 provided with a driving rod 2 for driving a nail, rivet or like fastening element 1 into a receiving material such as concrete, iron board or the like, a drive cylinder 4 having housed therein the drive piston 3 in a manner to permit it to slide in its lengthwise direction, a pressure chamber 5 disposed adjacent the drive cylinder 4, a main valve mechanism 71 disposed between the drive cylinder 4 and the pressure chamber 5, for controlling their connection to and disconnection from each other by a manually operable trigger valve mechanism 70, and a pressure intensifer 6 for intensifying the pressure of compressed air introduced thereinto from an air compressor or like air supply source to a higher pressure for supply into the pressure chamber 5. By introducing the compressed air in the pressure chamber 5 into the drive cylinder 4, the drive piston 3 is driven. The pneumatic tool A is further provided with a secondary pressure setting mechanism 7 for controlling the operation of the pressure converter 6 so that the pressure intensified by the pressure intensifier 6 may not exceed a predetermined value, a relief valve 8 for preventing air from remaining in the pressure chamber after each fastener driving work, the fastening element supply mechanism 80 and some mechanisms and means for preventing the contact shooting and the blank shooting.

Next, a brief description will be given, with reference to FIG. 1, of the flow of compressed air in the pneumatic tool A and the operation of the tool itself.

At first, compressed air from a compressed air source is introduced into the pressure intensifier 6, wherein it is pressurized, thereafter being charged into the pressure chamber 5 for storage. At this time, if the pressure of the compressed air is raised by the pressure intensifier 6 in excess of a preset value, the secondary pressure setting mechanism 7 operates to stop the operation of the pressure intensifier 6. The highly compressed air in the pressure chamber 5 is used for driving a fastening element 1 as required. After the fastening driving work, the relief valve 8 operates to discharge therethrough the pressurized air in the pressure chamber 5 to the atmosphere.

A first step for driving the pneumatic tool A is to manually operate a fastening element supply mechanism 80 to supply a fastening element 1 to a predetermined position forwardly of the drive piston 3. In association with this operation, a safety valve 94 is activated to supply the compressed air in the pressure chamber 5 into an expansion cylinder 91 of a contact member 68 at the tip of the pneumatic tool A through the trigger valve mechanism 70 and the safety valve 94, expanding the expansion cylinder 91. Then, when the contact member 68 is pressed against a receiving material, a pilot valve 81 is activated by the cooperation of the contact member 68 pressing operation and the expansion of the cylinder 91, permitting communication between the main valve 71 and the trigger valve mechanism 70. Next, by manually operating the trigger valve mechanism 70, the compressed air in an upper chamber 73 of a main valve cylinder is discharged therefrom to actuate the main valve 71 to permit communication between the pressure chamber 5 and the drive cylinder 4 and, as a result of this, the compressed air is introduced into the drive cylinder 4, causing it to propel the fastening element 1 into the receiving material.

At the same time, by the actuation of the trigger valve mechanism 70, the safety valve 94 interrupts the communication between the trigger valve mechanism 70 and the expansion cylinder 91 and discharges the air in the cylinder 91 to contract it, preventing further actuation of the pilot valve 81. In consequence, even if the contact member 68 is pressed against the receiving material, or even if the trigger valve mechanism 70 is activated again, the tool A would not operate.

Now, a detailed description will be given of each part of the above-described pneumatic tool.

The compressed air source is a means for supplying primary pressure air, and it may be an air compressor or the like for ordinary pneumatic tools.

Figure 2:
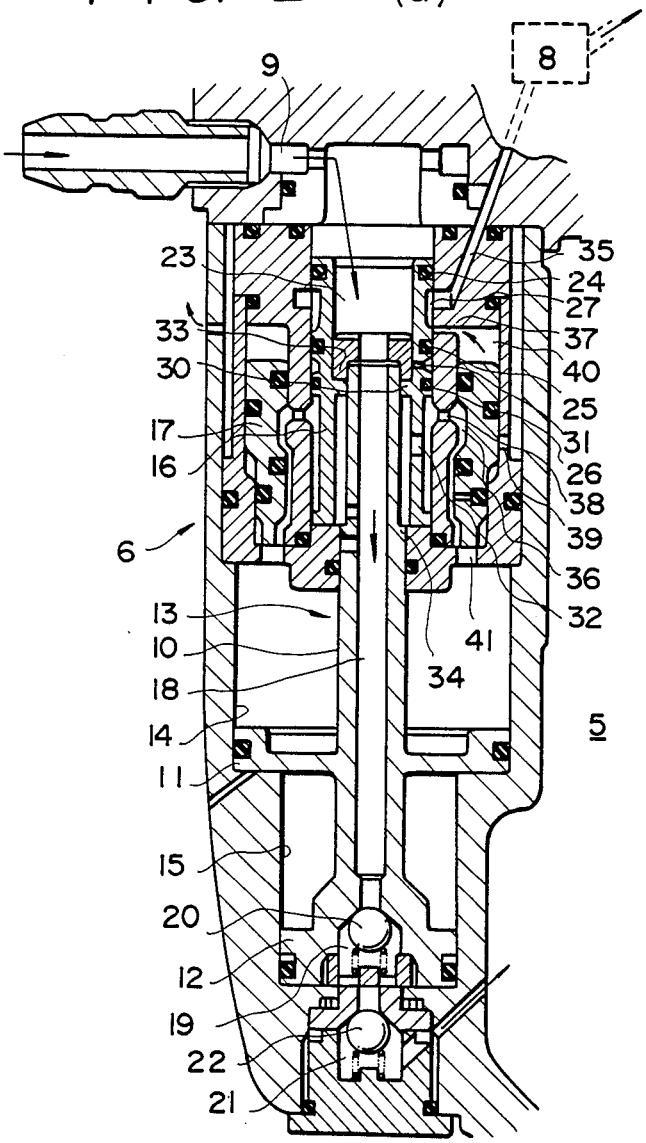
FIGS. 2(*a*), (*b*) and (*c*) are sectional views showing in detail a principal part P1 in FIG. 1.
Figure 2:
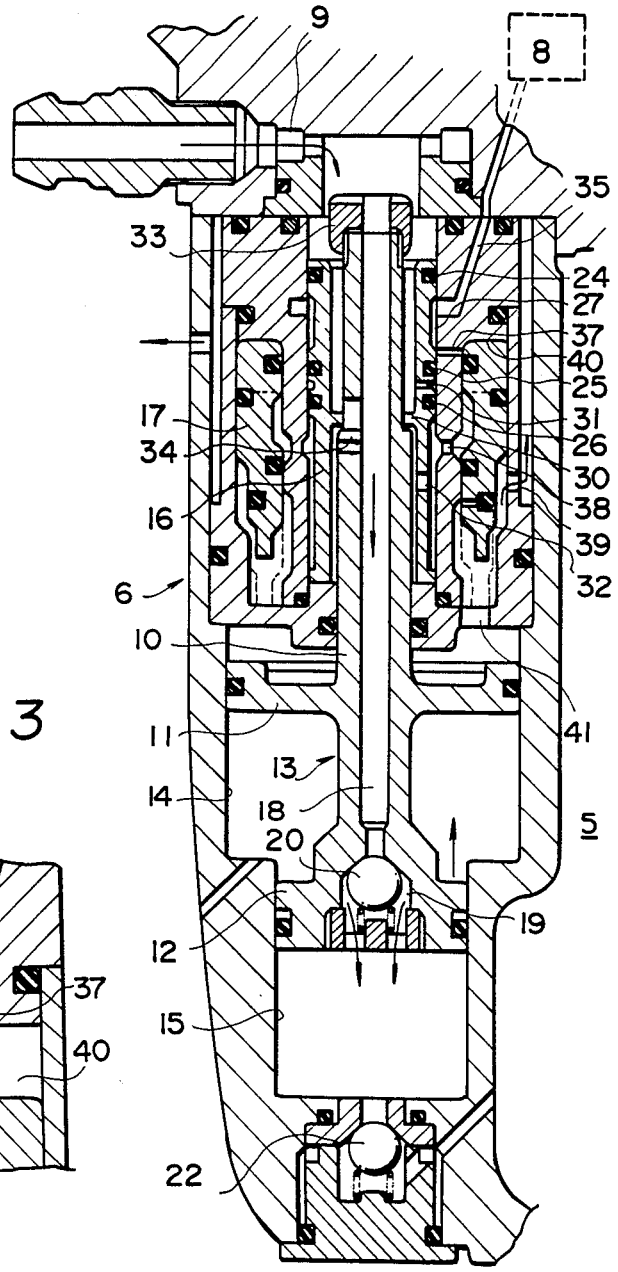

The pressure intensifier 6 as shown in FIG. 2(*a*), (*b*) and (*c*) is connected via an inlet 9 to the compressed air source. The pressure intensifier 6 comprises a double-headed pressure boost up piston 13 having a drive piston head 11 of a large effective area and a compressing piston head 12 of a small effective area which are coupled in tandem through a piston rod 10, a large diameter drive cylinder 14 and a small diameter pressure boost up cylinder 15 respectively having housed therein the piston heads 11 and 12 in a slidable manner, a timing valve 16 which is switched by the piston rod 10 in the vicinities of top and bottom dead centers of the piston 13, and a change-over valve 17 for selectively connecting the drive cylinder 14 to the compressed air source and the atmosphere. By a control air pressure based on the switching operation of the timing valve 16, the change-over valve 17 is actuated, by which air acting on the drive piston head 11 is introduced into and discharged from the drive cylinder 14, automatically driving the pressure boost up piston 13 for reciprocating movement.

The pressure boost up piston 13 has a bore 18 which extends therethrough in the lengthwise direction thereof. The bore 18 is always supplied with the primary pressure air from the compressed air source. In an opening 19 of the compressing piston head 12 is provided a check valve 20 for preventing a counterflow of the primary pressure air which is discharged from the bore 18. The small diameter cylinder 15 is connected via a secondary pressure air feeding chamber 21 to the pressure chamber 5. Also, in the feeding chamber 21 is provided a check valve 22.

The timing valve 16 is cylindrical in shape as shown in FIG. 2(*a*) and is housed in a timing valve chamber 23 in a manner to be movable reciprocatingly, together with the piston rod 10. The top end portion of the timing valve 16 has mounted thereon "O" rings 24, 25 and 26 at upper, central and lower portions thereof in FIG. 2(*a*), respectively. The timing valve 16 has an air hole 31 for actuating the change-over valve 17, formed between the central and lower "O" rings 25 and 26, and a primary pressure air supply port 32 formed below the lower "O" ring 26. The air hole 31 for actuating the change-over valve 17 is very small in diameter and is set to limit the air flow therethrough. A nut on end of piston rod 10 forms upper piston rod flange 33. The inner wall of the timing valve 16 has a projection 30 for engagement with upper and lower flanges 33 and 34 of the piston rod 10 so that the timing valve 16 operates following up the reciprocating movement of the piston rod 10.

The timing valve chamber 23 is connected to the compressed air source and is always filled with the primary pressure air. The timing valve chamber 23 has a port 35 communicating with the atmosphere and first and second ports 37 and 38 communicating with an upper chamber 40 of a directional control valve chamber 36 and the chamber 36 itself.

The change-over valve 17 is housed in the annular chamber 36 provided on the outside of the timing valve chamber 23 in such a manner to be reciprocatingly movable in axial alignment with the timing valve 16. The directional control valve chamber 36 has first and second ports 37 and 38 which communicate with the timing valve chamber 23, and an exhaust port 39 which is open to the atmosphere. Further, the directional control valve chamber 36 is in communication with the large diameter cylinder 14 through an opening 41, through which air in the large diameter cylinder 14 always acts on the lower end face of the change-over valve 17.

The timing valve 16 is arranged so that when the piston 13 lies at the bottom dead center thereof as shown in FIG. 2(*a*), the "O" ring 25 closes the air hole 31 for actuating the directional control valve 17 and the atmosphere communicates with the upper chamber 40 of the change-over valve chamber 36 through the first port 37 and the atmosphere communication port 35, and so that when the piston 13 lies at the top dead center thereof as shown in FIG. 2(*c*), the "O" ring 25 closes the atmosphere communication port 35 and the timing valve chamber 23 communicates with the upper chamber 40 of the directional control valve chamber 36 through the air hole 31 and the first port 37. The primary pressure air supply port 32 is always connected to the second port 38. The change-over valve 17 is arranged so that when the piston 13 lies at the top dead center thereof, it closes the second port 38 and establishes communication between the large diameter cylinder 14 and the atmosphere through the opening 41 and the exhaust port 39, and so that when the piston 13 lies at the bottom dead center thereof, it closes the exhaust port 39 and establishes communication between the timing valve chamber 23 and the large diameter cylinder 14 through the opening 41 and the second port 38. It will be understood that the annular chamber 36, located above cylinder 14, is defined by a lower stationary cupped-shaped plug and the necked-down depending extension of an abutting upper stationary plug. The concentric inner chamber 23 is defined by the hollow core of the upper plug and its extension.

Next, a description will be given of the operation of the pressure intensifier 6 of the above-described arrangement.

When the boost up piston 13 has moved down to a certain position from its top dead center, the upper flange 33 of the piston rod 10 engages the projection 30 of the timing valve chamber 36 still retained at the position of the top dead center and the piston 13 continues further downward movement to the bottom dead center while bringing the timing valve 16 down to its lowermost position as shown in FIG. 2(*a*). When the timing valve 16 is moved down, the central "O" ring 25 passes across the first port 37, so that the first port 37 communicates with the atmosphere communication through a space 27 defined between the upper and the central "O" rings 24 and 25, and the air in the upper chamber 40 of the directional control valve chamber 36 is immediately discharged to the atmosphere to rapidly reduce the pressure in the upper chamber 40, resulting in decreased pressure acting on the top pressure receiving surface of the directional control valve 17. On the other hand, since the air in the large diameter cylinder 14 is acting on the bottom pressure receiving surface of the change-over valve 17, the balance between the pressures acting on the top and bottom pressure receiving surfaces of the valve 17 is reversed, pushing up the valve 17. In this case, since the atmosphere communication port 35 and the first port 37 each have a sufficiently large opening for a smooth exhaust therethrough, the air in the upper chamber 40 of the directional control valve chamber 36 is immediately discharged to the atmosphere, permitting the change-over valve 17 to operate for switching the boost up piston 13 from its forward stroke for boosting up pressure to its return stroke. When the change-over valve 17 has thus moved up to reach its uppermost position, communication is established between the large diameter cylinder 14 and the exhaust port 38, and the air in the large diameter cylinder 14 is discharged through the exhaust port 39 to diminish the pressure in the cylinder 14, too, resulting in the pressure acting on the drive piston head 11 being gradually reduced down to the atmospheric pressure. In contrast thereto, since the tip of the compressing piston head 12 is always exposed to at least the primary pressure air, the balance between the pressure acting on the both pressure receiving surfaces of the boost up piston 13 is reversed, and the piston 13 starts to move up from the position of its bottom dead center, that is, it is switched to the return stroke. In this way, the boost up piston 13 is quickly switched between the forward and the return stroke.

During the upward movement of the boost up piston 13, too, the primary pressure air is supplied into the small diameter cylinder 15 through the tip of the compressing piston head 12, but since the capacity of the small diameter cylinder 15 gradually increases as the boost up piston 13 rises, the internal pressure of the cylinder 15 becomes lower than the primary pressure.

When the boost up piston 13 has thus been moved up to a predetermined position, the lower flange 34 of the piston rod 10 gets into engagement with the projection 30 of the timing valve 16 held at the position of the bottom dead center and the boost up piston 13 continues further upward movement to the top dead center while bringing the timing valve 16 up to its uppermost position as shown in FIG. 2(*c*). When the timing valve 16 is thus moved up, the "O" ring 25 passes across the first port 37, so that the first port 37 and the air supply port 31 for actuating the directional control valve 17. In consequence, the primary pressure air in the timing valve chamber 23 is charged into the upper chamber of the directional control valve chamber 36 and, due to the difference between the upper and lower effective areas of the change-over valve 17, the downward force acting thereon overcomes the upward force, lowering the valve 17.

Figure 3:
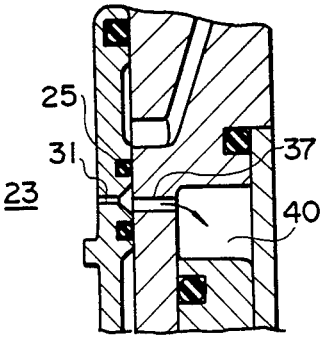
FIG. 3 is a sectional view of a mechanism for improving the pressure raising efficiency of a pressure intensifier.
Figure 2:
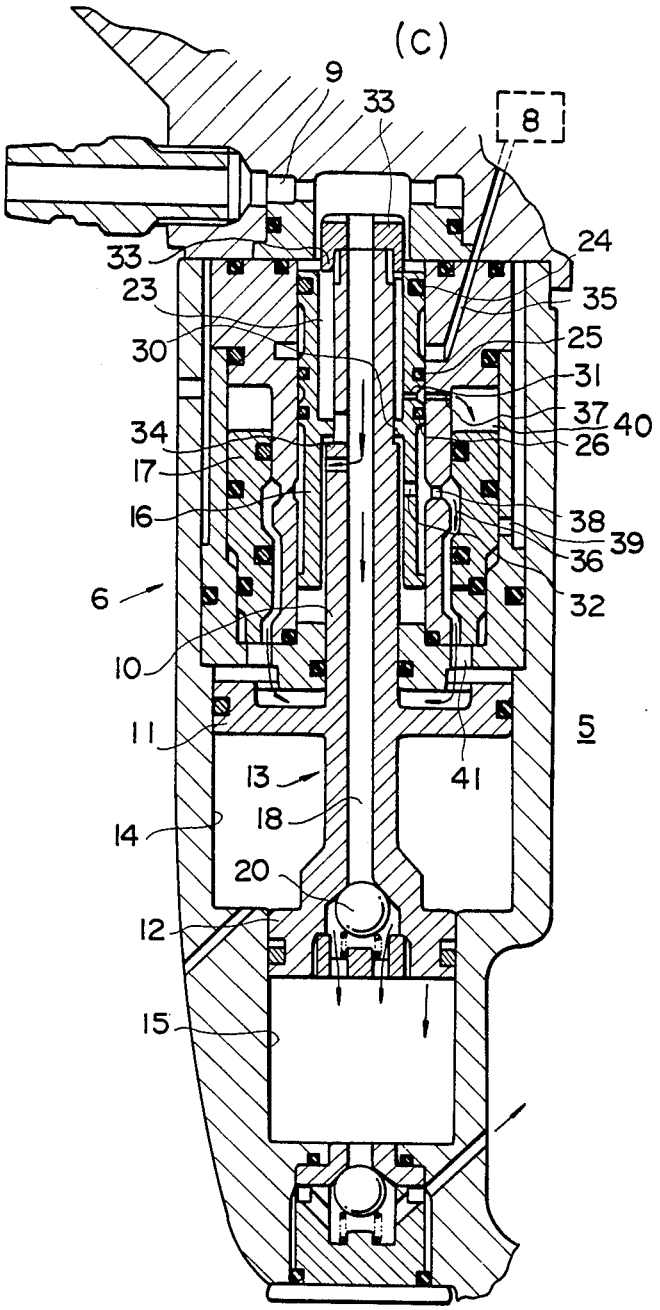

Incidentally, as shown in FIG. 3, the air hole 31 made in the timing valve 16 for actuating the change-over valve 17, which forms a passage for the supply of air for actuating the valve 17, is small in diameter and supplies the upper chamber 40 of the directional control valve chamber 36 with the primary pressure air in small quantity per unit time. Accordingly, the pressure in the upper chamber 40 does not rapidly rise, occasioning a delay in the operation of the change-over valve 17. This slows down the upward movement of the boost up piston 13 to retard its switching to the forward stroke and, in this while, the supply of the primary pressure air into the small diameter cylinder 15 is kept on, so that the internal pressure of the cylinder 15 becomes nearly equal to the primary pressure.

Thereafter, when the change-over valve 17 moves down, the exhaust port 39 is closed, but instead communication is established between the timing valve chamber 23 and the large diameter cylinder 14 and, consequently, the primary pressure air is charged into the large diameter cylinder 14, wherein it acts on the drive piston head 11. Owing to the difference between the effective areas of the drive piston head 11 and the compression piston 12, the balance between the pressure acting on the top and the bottom end of the boost up piston 13 is reversed to switch it to the forward stroke again, and the air in the small diameter cylinder 15 raised almost up to the primary pressure is compressed by the compression piston head 12 and hence is raised in pressure. The resulting secondary pressure air thus obtained is delivered from the secondary pressure air delivery chamber 21 to the pressure chamber 5 for storage.

Thereafter, the boost up piston 13 is repeatedly switched between the forward and the return stroke in the same manner as described above.

In the pressure intensifier 6, as described above, the forward or backward stroke of the boost up piston 13 starts with the actuation of the change-over valve 17, which is followed by the actuation of the boost up piston 13, which is then followed by lagged actuation of the timing valve 16. The timing valve 16 promotes the next switching operation of the change-over valve 17, which in turn switches the boost up piston 13 to the next step. Since the switching of the boost up piston 13 from the return stroke to the forward stroke is delayed, the internal pressure of the small diameter cylinder 15 is boosted after being sufficiently raised almost to the primary pressure. In contrast thereto, the switching of the boost up piston 13 from the forward stroke to the backward stroke is rapidly carried out. Accordingly, the intensification efficiency of the pressure intensifier 6 is very high. Also, as the secondary pressure air is stored in the pressure chamber 5 and is used for shooting fastening element when necessary, as described later, the tool A itself can be formed compact.

Figure 4:
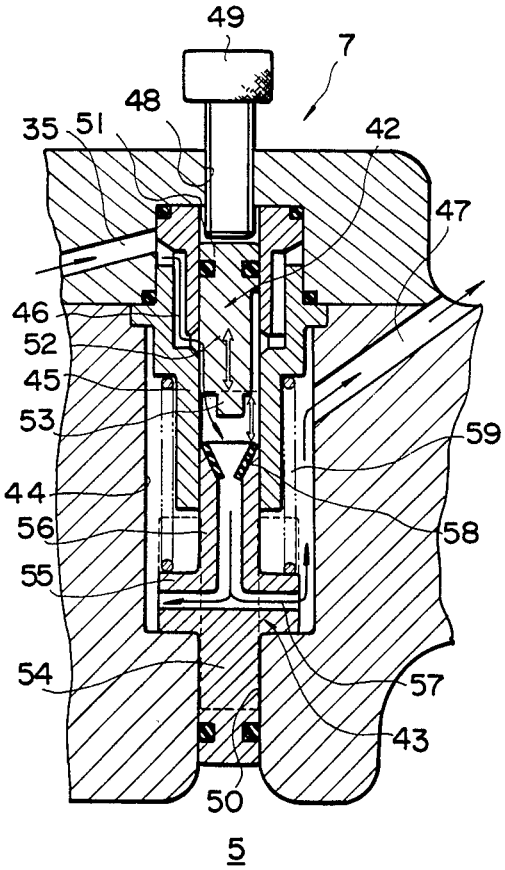
FIG. 4 is a sectional view showing in detail an arrangement for setting a secondary pressure, identified by P2 in FIG. 1.

Next, a description will be given, with reference to FIG. 4, of the secondary pressure setting mechanism 7. As illustrated, the secondary pressure setting mechanism 7 has a face for receiving the pressurized air in the pressure chamber 5, and is provided with a second valve stem 43 which is displaced in accordance with the pressure in the chamber 5, a first valve stem 42 which is displaceable by a manual operation and a valve cylinder 44 in which the first and second valve stems 42 and 43 are disposed in opposing relation. When the pressure in the pressure chamber 5 has reached an arbitrarily settable pressure, the first and second valve stems 42 and 43 cooperates to close the exhaust passage of the pressure intensifier 6, stopping its drive.

The valve cylinder 44 has contained therein a valve sleeve 45 disposed at the upper side thereof. The valve sleeve 45 is open at one end to the aforementioned atmosphere communication port 35 and at the other end to the valve cylinder 44. In one side of the valve cylinder 44 is made an exhaust passage 47 which leads to the atmosphere. Further, the valve cylinder 44 has made therein at one end in its lengthwise direction a threaded hole 48 which leads to the outside and into which an adjustment screw 49 is threaded and at the other end a stem receiving hole 50 which leads to the pressure chamber 5.

The valve sleeve 45 may be connected to the exhaust port 39 instead of to the atmosphere communication port 35.

The first valve stem 42 has an upper end portion 51 of circular across section, an intermediate portion 52 of triangular cross section and a semi-spherical lower end portion 53. The upper end portion 51 is in close contact with the interior surface of the upper portion of the valve sleeve 45. On the other hand, there is defined between the intermediate portion 52 and the lower end portion 53 of the first valve stem 42 and the inner wall of the valve sleeve 45 an air passage 46 which leads to the abovesaid atmosphere communication port 35. The exhaust air from the upper chamber 40 of the change-over valve 17, which is introduced through the atmosphere communication port 35, is directed into a space forwardly of the first valve stem 42 through the air passage 46. Accordingly, the first valve stem 42 receives at its lower end the primary pressure, and hence is always pressed upwardly. The first valve stem 42 is retained at a lower position by tightening the adjustment screw 49 and when the screw 49 is loosened, it is moved up.

The second valve stem 43 is comprised of a tubular base 54 having a flange 55 formed at the upper end thereof and a pipe member 56. The pipe member 56 is fitted into the valve sleeve 45 in opposing relation to the lower end portion 53 of the first valve stem 42, and the base 54 is fitted into the passage 50 made in the valve cylinder 44 to extend to the pressure chamber 5. The second valve stem 43 has formed therein an exhaust passage 57 which extends through the pipe member 56 and the flange 55. A sealing member 58 as of the rubber is mounted on the inner wall of the open end portion of the pipe member 56 to provide a seal. Usually the exhaust air flowing into the valve cylinder 44 from the atmosphere communication port 35 passes through the exhaust passages 46 and 57, thereafter being discharged through the exhaust passage 47. Since the end face of the base 54 is always exposed to the secondary pressure in the pressure chamber 5, the second valve stem 43 is urged upwardly at all times but, in order to hold it in position against the secondary pressure, a spring 59 is interposed between the flange 55 and the valve sleeve 45. The second valve stem 43 is held by the balance between the force of the spring 59 and the secondary pressure. When the secondary pressure exceeds the spring force, the second valve stem 43 is pushed up and when the secondary pressure falls below the spring force, the stem 43 is forced down.

Next, a description will be given of the operation of the secondary pressure setting mechanism 7.

The first valve stem 42 is designed to be adjustable by the adjustment screw 49 from the outside, whereas the second valve stem 43 moves in accordance with the magnitude of the secondary pressure. Accordingly, when an air gap is present between the first and second valve stems 42 and 43, the exhaust passages 46 and 57 are in communication with each other and, further, the atmosphere communication port 35 of the change-over valve 17 and the exhaust passage 57 are in communication with each other, permitting the pressure intensifier 6 to continue its boosting-up operation. As the secondary pressure in the pressure chamber 5 gradually rises, the second valve stem 43 moves upwardly, and finally its sealing member 58 is brought into engagement with the lower end portion 53 of the first valve stem 42, closing the exhaust passage 57. When the exhaust is stopped, the change-over valve 17 does not operate, so that the charge of the primary pressure air to and the discharge thereof from the drive piston head 11 do not take place, either, stopping the boost up piston 13 from operation. Accordingly, by adjusting, through the adjustment screw 49 from the outside, the position of the first valve stem 42 which cooperates with the second valve stem 43 to close the exhaust passages 46 and 57, it is possible to control the boost-up operation of the boost up piston 13 for arbitrary setting of the secondary pressure. Thereafter, when the secondary pressure goes down under the preset value, the exhaust passage opens and the pressure intensifier 6 starts again.

Letting the primary pressure be represented by P1 and the effective areas of the drive piston heads 11 and 12 of the boost up piston 13 be represented by S1 and S2, respectively, a maximum secondary pressure Pm can be expressed by $$Pm = P1 \times (S1/S2).$$

According to the setting mechanism 7 described above, the secondary pressure can easily be set, as desired, within the range of the maximum pressure Pm, by resupplying a sufficiently high primary pressure and by adjustment with the adjustment screw 49.

Since the second valve stem 43 moves in porportion to the magnitude of the secondary pressure, the secondary pressure can readily be recognized by a visual observation of the movement of the second valve stem 43 with the aid of graduations or the like.

Figure 5:
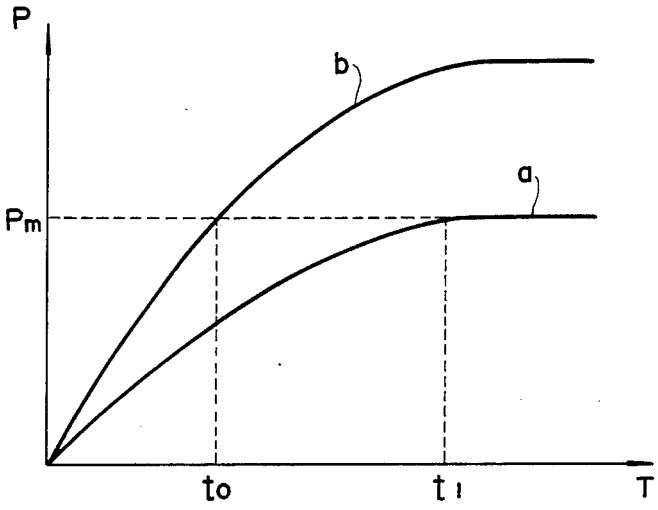
FIG. 5 is a graph showing the relationship between the pressure of the pressure intensifier during its operation and time.

FIG. 5 shows the relationship between the pressure P obtainable with the pressure intensifier 6 and time T. As will be appreciated from FIG. 5, one of the features of the pressure intensifier 6 described previously is that the cycle of its boost-up operation becomes longer as the maximum pressure is approached. For example, in the case of converting a primary pressure into a predetermined secondary pressure Pm as indicated by a curve a, a time t1 is required. With the above-described secondary pressure setting mechanism 7, however, since a high primary pressure indicated by a curve b is presupplied, the same secondary pressure can be obtained in a far shorter time t0.

Figure 6:
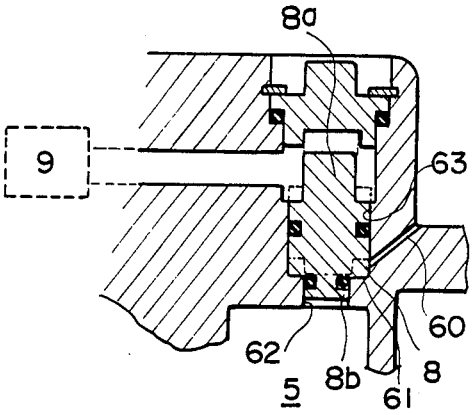
FIG. 6 is a sectional view showing in detail a relief valve indicated by P3 in FIG. 1.

FIG. 6 illustrates the relief valve 8, which is provided in a passage through which the pressure chamber 5 communicates with the atmosphere. The relief valve 8 is normally held at its closed position under the action of the air supplied from the compressed air source. When the supply of the compressed air from the compressed air source is stopped, the relief valve 8 is opened to atmosphere, by which it is actuated to its open position under the action of the compressed air in the pressure chamber 5, discharging therefrom the pressurized air to the outside.

That is, a valve cylinder 61 is provided in a passage through which an air escape 60 leading to the atmosphere and the pressure chamber 5 communicate with each other. The valve-cylinder 61 is formed so that its inner diameter on a secondary-pressure side portion 62 of the relief valve 8 is smaller than the inner diameter of a primary-pressure side 63 thereof. The abovesaid valve-cylinder 61 is open to the primary air inlet port 9. The relief valve 8 is constituted in the form of such a reducing piston valve that the outer diameter of the primary-pressure side portion 8*a* is larger than the outer diameter of the secondary-pressure side portion 8*b* in accordance with the difference between the abovesaid inner diameters of the cylinder. The relief valve 8 is inserted into the cylinder in a manner to be movable reciprocatingly therein. The small diameter portion 8*b* is exposed to the secondary pressure air, and the large diameter portion 8*a* is exposed to the primary pressure air. Accordingly, when the ratio of the effective area of the large diameter portion 8*a* to the effective area of the small diameter portion 8*b* is equal to a reciprocal ratio of the ratio of the pressures acting on the both portions 8*b* and 8*a*, the relief valve 8 stays its equilibrium state. When the area ratio of the large diameter portion 8*a* to the small diameter portion 8*a* exceeds the reciprocal ratio of the ratio of the pressures applied to the respective portions, the relief valve 8 loses its equilibrium and moves towards the side of the small diameter portion 8*b*. Therefore, it is preferable to set the size of the valve cylinder 61 so that the relief valve 8 may reach its equilibrium state when the secondary pressure in the valve-cylinder becomes equal to the maximum pressure produced by the pressure intensifier 6.

With the relief valve 8 of such a construction as described above, when an air chuck 65 is removed, for instance, after the fastener driving work, to cut off the primary pressure air supply from the compressed air source to the pneumatic tool A, the primary pressure is reduced and the secondary pressure air in the pressure chamber 5 remains therein. As a result of this, the difference between the pressure acting on both ends of the relief valve 8 becomes extremely large, and the relief valve 8 is moved to the primary pressure side by the secondary pressure air acting on the end face of the small diameter portion 8*b*. This movement permits the pressure chamber 5 to communicate with the air escape 60, discharging the secondary pressure air in the pressure chamber 5 to the atmosphere. Thereafter, when the primary pressure air is introduced again through the primary pressure air inlet 9, the high-pressure air is exerted on the relief valve 8 at the side of the primary pressure to move it back to its initial position, interrupting the communication between the air escape 60 and the pressure chamber 5 to re-store the secondary pressure air in the latter.

The highly compressed secondary pressure air thus charged into the pressure chamber 5 from the pressure intensifier 6 is used for driving a fastening element into a receiving material in such a manner as will be described hereunder.

Figure 11:
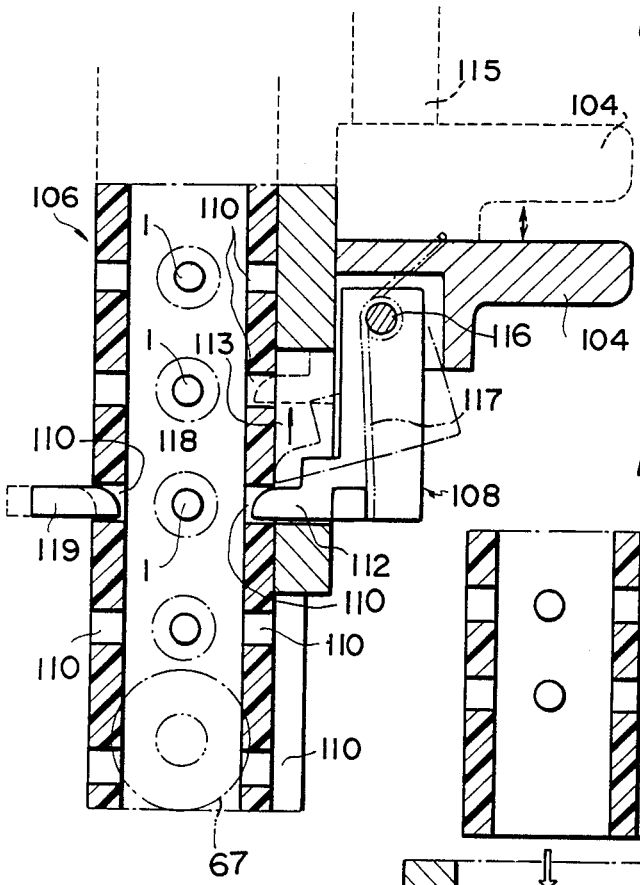
FIGS. 11 and 12 are sectional views taken on the lines X—X and Y—Y in FIG. 10, respectively.

As shown in FIG. 11, the fastening element driving work starts with loading the fastening element 1 into a nose part 67 for guiding the drive piston 2 coupled with the drive piston 3. By pressing against the surface of the receiving material a contact member 68 disposed along the nose part 67 to project out forwardly thereof and by pulling a trigger lever 69 to actuate the trigger valve mechanism 70, the fastening element 1 is propelled into the receiving material.

Figure 7:
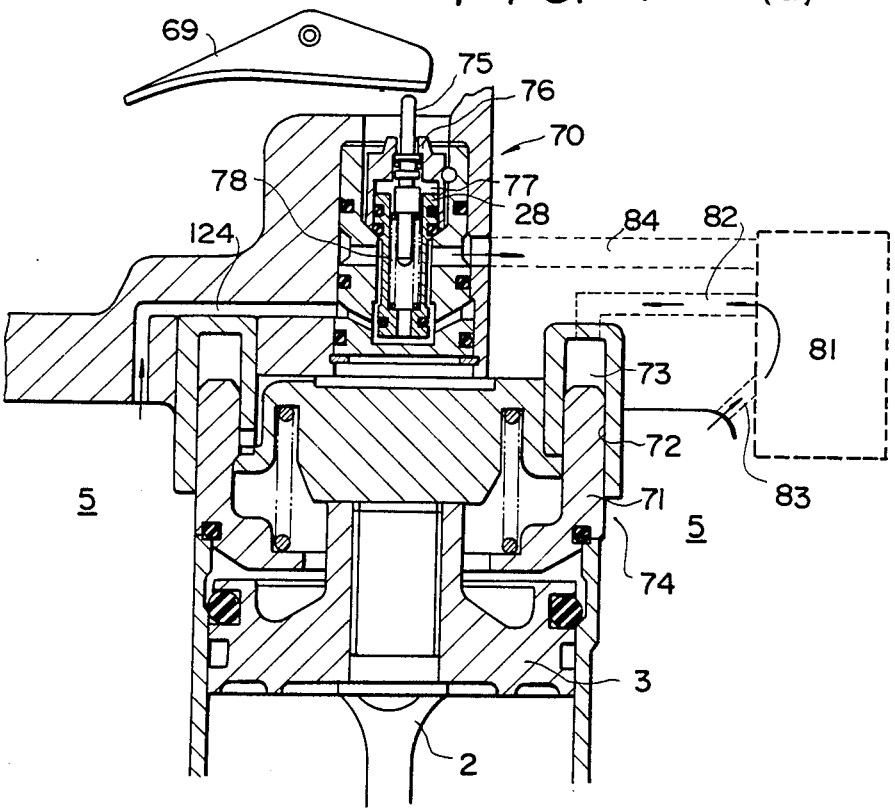
FIGS. 7(*a*) and (*b*) are diagrams explanatory of the operative states of a trigger valve arrangement and a main valve arrangement, identified by P4 in FIG. 1.
Figure 7:
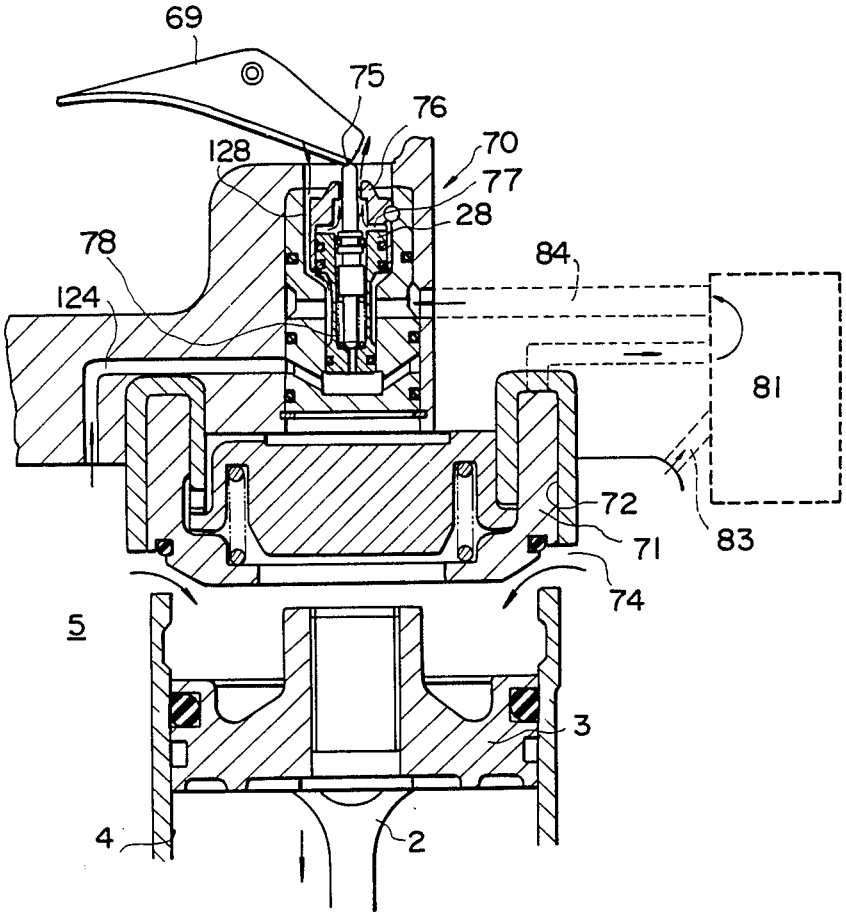

The trigger valve mechanism 70 is provided between an upper chamber 73 of a main valve chamber 72 in which a main valve 71 is housed in a manner to be reciprocatingly movable and the pressure chamber 5. The trigger valve mechanism 70 is always charged with the highly compressed air from the pressure chamber 5 through the passage 124. Usually, as shown in FIG. 7(*a*), a trigger valve 28 maintains communication with a passage 84 for supplying the highly compressed air to the upper chamber 73 of the main valve chamber 72. By pulling the trigger lever 69 to press in a valve stem 125, sealing between the valve stem 75 and an opening 76 of a valve cylinder is removed to discharge the air in the upper chamber 77 of the valve cylinder. As a result of this, the trigger valve 28 is actuated to interrupt the communication between the passages 124 and 84 and to provide an exhaust passage 128 which leads the passage 84 to the atmosphere, as shown in FIG. 2(*b*). When the trigger valve mechanism 70 is in its inoperative state, the main valve 71 is held at such a position as to close a drive air supply port 74 between the drive cylinder 4 and the pressure chamber 5 and, when the mechanism 70 is activated, the air in the upper chamber 73 of the main valve chamber is discharged to open the drive air supply port 74, introducing the highly compressed air in the pressure chamber 5 into the drive cylinder 4.

Upon releasing the trigger lever 69, the valve stem 125 is returned by the force of a spring 78 to provide a seal between the stem 125 and the inner wall of the opening 126, admitting the compressed air into the upper chamber 127 from the pressure chamber 5 to return the trigger valve 28 to its initial state shown in FIG. 7(*a*). At the same time, the exhaust passage 128 is closed.

By the actuation of the trigger valve mechanism 70, the main valve 71 is moved up to establish communication between the drive cylinder 4 and the pressure chamber 5 to instantaneously supply the highly compressed air in the latter into the former in large quantity, by which the drive piston 3 is propelled to strike the drive rod 2, driving the fastening element 1 out of the nose part 67 into a receiving material.

Releasing the trigger lever 69, the highly compressed air in the pressure chamber 5 is charged again into the upper chamber 73 of the main valve 71 via the trigger valve mechanism 70 to lower the main valve 71, closing the drive air supply port 74. By the reduction of the pressure in the pressure chamber 5 which results from the consumption of the pressurized air by the fastening element driving work, the pressure intensifier 6 is automatically started, thus maintaining the pressure in the pressure chamber 5 at a predetermined value.

The pneumatic tool A equipped with the pressure intensifier 6 is very high-output and its accidental discharge is very dangerous. To avoid the accidental discharge, the pneumatic tool of the present invention is provided with a safety system by which the operation of the trigger valve mechanism 70 is associated with the operation of pressing the contact member 68 against a receiving material and the operation of a fastening element supply mechanism 80.

The actuation of the main valve 71 is performed in association with the actuation of the trigger valve mechanism 70. For safety's sake, the upper chamber 73 of the main valve cylinder is normally in direct communication with the pressure chamber 5, as shown in FIG. 7(*a*) and, only when it is connected to the trigger valve mechanism 70, as shown in FIG. 7(*b*), the pneumatic tool A is made ready for operation. The main valve 71 is selectively connected to the pressure chamber 5 or the trigger valve mechanism 70 under the control of a pilot valve 81.

Figure 8:
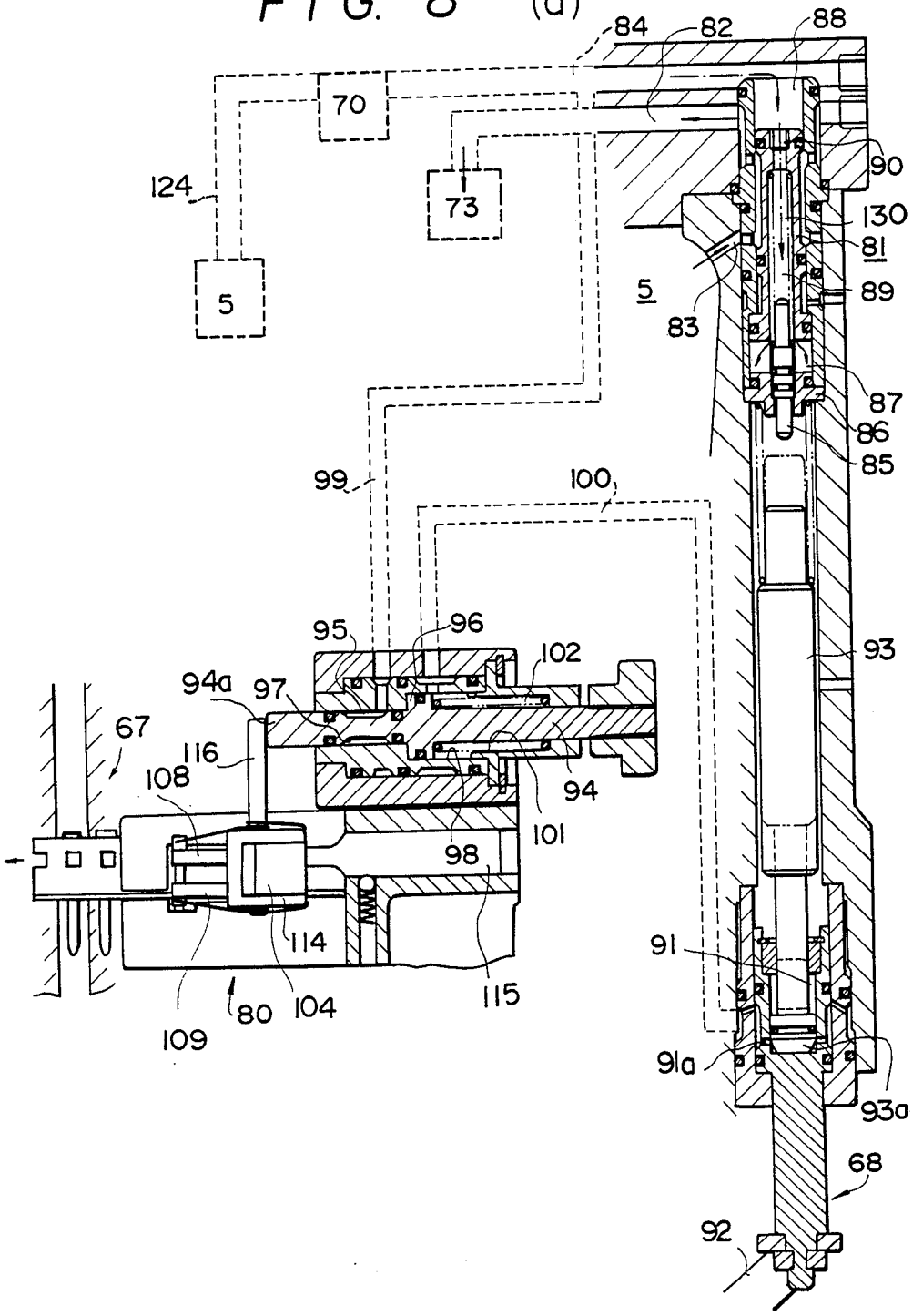
FIGS. 8(*a*) and (*b*) are diagrams explanatory of the operative state of a safety mechanism indicated by P5 and P6 in FIG. 1.
Figure 8:
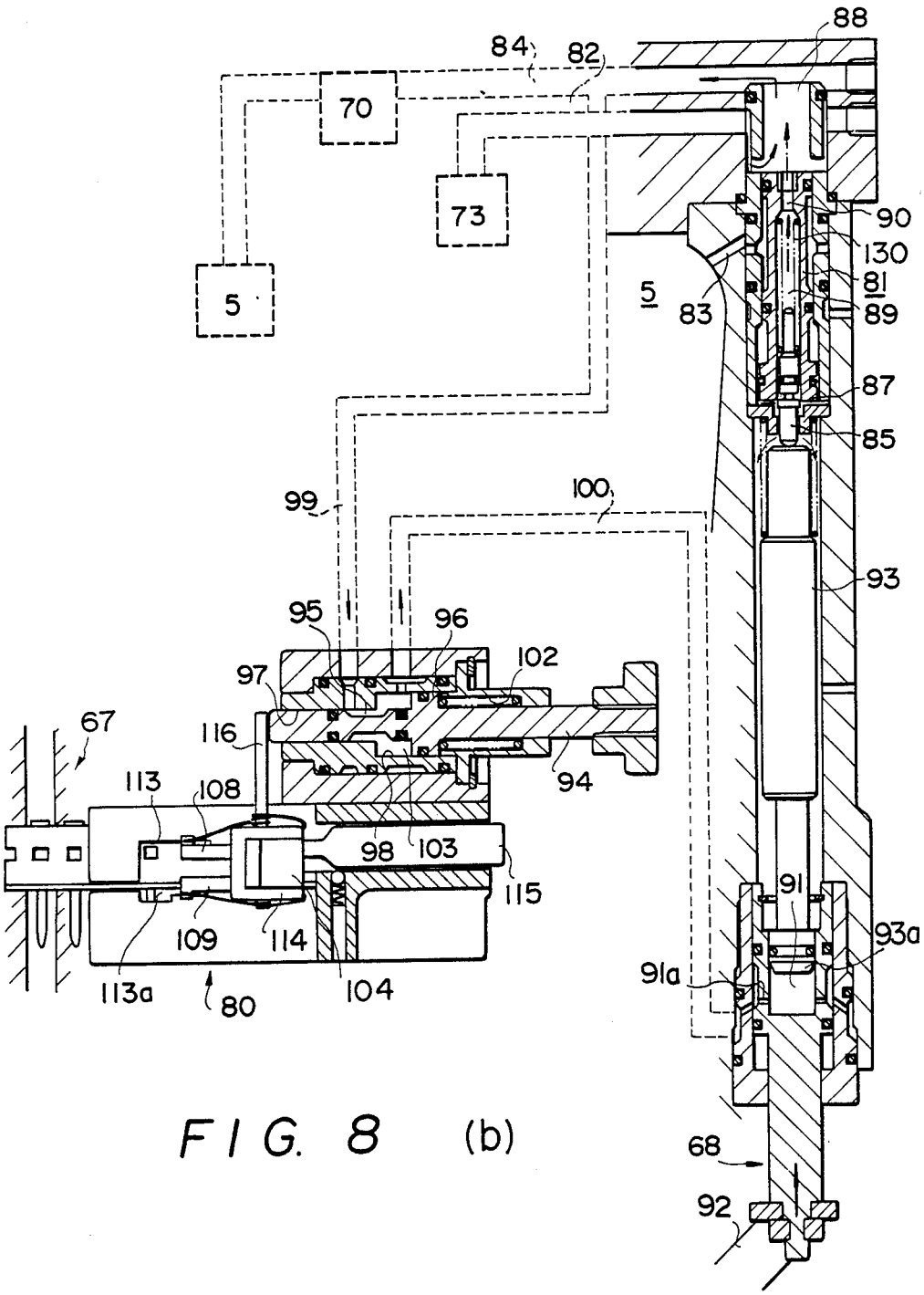

As illustrated in FIGS. 8(*a*) and (*b*), the pilot valve 81 is substantially cylindrical in shape. It is moved up and down in a valve cylinder 86 by means of a spring 130, by which an air passage 82 leading to the upper chamber 73 of the main valve cylinder is selectively communicated with an air passage 83 leading to the pressure chamber 5 or an air passage 84 leading to the trigger valve mechanism 70, controlling the opening and closure of the main valve 71. The pilot valve 81 normally lies at its top dead center in FIG. 8(*a*), directly connecting the upper chamber 73 of the main valve cylinder to the pressure chamber 5. Only when the tip of the contact member 68 pushes up a valve stem 85, sealing between the stem 85 and a valve cap 86 is removed to discharge air in a lower chamber 87 of the valve cylinder to the outside through a gap around the valve stem 85, removing the air pressure supporting the pilot valve 81 to permit it to move down to its bottom dead center as shown in FIG. 8(*b*). At this time, the air passage 82 leading to the upper chamber 73 is connected to the air passage 84 leading to the trigger valve mechanism 70. Thus, the air connection circuit is switched to make the pneumatic tool A ready for operation.

Then, when pulling the trigger lever 69, the highly compressed air in the upper chamber of the main valve cylinder is discharged through the trigger valve mechanism 70 to establish communication between the pressure chamber 5 and the drive cylinder 4, propelling the drive piston 3. Upon pulling the trigger lever 69, the air in an upper chamber 88 of the valve cylinder is exhausted and, at the same time, the air in the pilot valve 81 is also discharged through a bore 89 made therein to extend therethrough. In this case, since a throttle hole 90, which is made in the pilot valve 81, at the upper end of the bore 89, does not permit smooth discharging of the air, the pilot valve 81 is automatically moved up to its top dead center by the remaining pressure in the bore 89 and the force of the spring 130 installed between the pilot valve 81 and the valve stem 85.

Releasing the trigger lever 69, the highly compressed air is supplied from the pressure chamber 5 to the lower chamber 87 through the trigger valve mechanism 70 and the bore 89 of the pilot valve 81, by which the pilot valve 81 is retained at the top dead center.

Accordingly, switching of the air connection circuits by the downward movement of the pilot valve 8 from the top dead center takes place when the tip of the contact member 68 has pressed the lower valve stem 85 and, at this time, the pneumatic tool A is still held ready for operation.

As illustrated in FIGS. 1 and 8(*a*) and (*b*), the contact member 68 is provided adjacent the muzzle part 67, and is comprised of a contact arm 92 which is pressed against a receiving material when shooting a fastening element thereto, an expansion cylinder 91 mounted on the contact arm 93 at one end thereof and a piston part 93*a* of a piston member 93 disposed in the expansion cylinder 91 in opposing relation to the valve stem 85. When supplied with air through its lower end 91*a*, the expansion cylinder 91 expands to thrust up the piston member 92, extending the contact member 68 as a whole. Then, by pressing the tip of a contact rod 92*a* of the contact arm 92 against the receiving material, the contact member 68 is moved up to strike against the piston member 92, which in turn pushes up the valve stem 85, activating the pilot valve 81 for the abovesaid switching operation. In contrast thereto, the expansion cylinder 91, when not supplied with air, remains in its contracted state and, accordingly, the contact member 68 stays short in its entirety, so that the valve stem 85 cannot be pushed up even if the contact member 88 is pressed against the receiving material.

As will be appreciated from the above, in order that the pilot valve 81 for controlling the opening and closure of the main valve 71 may be actuated by the valve stem 85 which is thrust up by the contact member 68, it is necessary to supply air to the expansion cylinder 91 as well as to press the contact arm 92 against the receiving material. The air to the expansion cylinder 91 is supplied from a safety valve 94.

The safety valve 94 is provided in association with the trigger valve mechanism 70, and has a first position where to permit driving of the tool A and a second position where to inhibit driving of the tool A. As shown in FIGS. 8(*a*) and (*b*), the safety valve 94 has an annular recess 98 formed in its forward portion 94*a* and an expanded portion 96 formed in its intermediate portion. The safety valve 94 is mounted in a cylindrical valve housing 101 in a manner to be movable reciprocatingly between a forward first position and a rearward second position, the front end portion 94*a* of the safety valve 94 forwardly of the recess 95 projecting out of the front end of the valve housing 101. The valve housing 101 has a front room 97 and a rear room 98 which is larger in inner diameter than that of the former, and communicates with the trigger valve mechanism 70 and the expansion cylinder 91 through front and rear air passages 99 and 100, respectively. A coiled spring 102 is disposed between the expanded portion 96 and the rear end portion of the valve housing 101. The air passage 99 is open to the aforementioned air passage 84, and the air passage 100 is connected to the opening 91*a* of the expansion cylinder 91.

When the safety valve 94 lies at the first position as shown in FIG. 8(*a*), the air in the pressure chamber 5 is supplied through the trigger valve mechanism 70, the air passage 84 and the air passage 99 to the annular recess 95 of the safety valve 94 to act on both front and rear inner walls of the recess 95 at the same pressure. Accordingly, the safety valve 94 is normally biased by the force of the coiled spfing 102 to the first position. In this case, since communication between the front and rear air passages 99 and 100 is blocked, the output air from the safety valve 94 cannot be applied to the expansion cylinder 91 of the contact member 68. On the other hand, when the safety valve 94 is retracted to the second position, as shown in FIG. 8(*b*), the rear room 98 of the valve housing 101 and the recess 95 of the safety valve 94 are jointed together by the retraction of the expanded portion 96 as indicated by 103. In consequence, the front and rear air passages 99 and 100 are interconnected through the space 103, establishing communication between the trigger valve mechanism 70 and the expansion cylinder 91 to expand the latter. In such a case, the highly compressed air supplied through the air passage 99 acts on the front inner wall of the recess 95 and the front end face of the expanded part 96 in opposite directions. The safety valve 94 is designed so that the rearward pressure acting on the front end face of the expanded part 96 may exceed the forward prssure on the front inner wall of the recess 95 plus the force of the spring 102. Therefore, the safety valve 94 retracted to the second position stays there by itself. When the air in the air passage 99 is discharged through the trigger valve mechanism 70 in synchronism with the shooting operation of the pneumatic tool A, the air in the safety valve 94 and the expansion cylinder 91 is also discharged and, consequently, the air pressure exerted on the safety valve 94 is also removed. As a result of this, the safety valve 94 loses its self-holding force and, under the action of the spring 102, it is advanced again to the first position and held there, interrupting the communication between the air passages 99 and 100. At this time, the expansion cylinder 91 contracts, making the pneumatic tool A inoperative.

As described above, it is necessary, for driving the pneumatic tool A, not only to press the contact member against the receiving material but also to supply the output air from the safety valve 94 to the expansion cylinder 91. Since the output air from the safety valve 94 is supplied to the expansion cylinder 91 when the trigger valve mechanism 70 is in its inoperative state, if the trigger valve mechanism 70 is actuated before the contact member is pressed against the receiving material, the output air from the safety valve 94 is released into the atmosphere to contract the expansion cylinder 91, so that even if the contact member is pressed against the receiving material, the pneumatic tool A would not be driven. In this way, blank shooting is avoided. Therefore, the tool A must be activated by pulling the trigger lever 69 after pressing the contact number 68 and the extreme end of the muzzle part 67 against a receiving material; this ensures safety driving of the fastening element 1.

Incidentally, the means for expanding and contracting the contact member 68 need not always be limited specifically to the expansion cylinder 91, but may also be any means so long as it operates on the air pressure from the safety valve 94.

In short, the pneumatic tool A of the present invention can be driven only when the safety valve 94 lies at the second position. The safety valve 94 is brought from the first position to the second position where to permit the actuation of the pilot valve 81, in association with the operation for loading the fastening element 1 into the muzzle part 67 and, thereafter, it remains there in a self-holding manner.

Next, a description will be given, with reference to FIG. 8(*a*), (*b*) and FIGS. 9 to 12, of the fastening element supply mechanism 80.

The fastener supply mechanism 80 comprises, as shown in FIGS. 9 and 10, guide means 107 for guiding the fastener 1 carried by a fastener carrier 106 to a predetermined position in front of the drive rod 4, feed means 108 provided in a manner to be movable reciprocatingly along the guide means 107 and lock means 109 which, when the fastener 1 is loaded in the guide means 107, engages the fastener 1 or the carrier 106 to permit the reciprocating movement of the feed means 108 but, when the fastener 1 is not loaded in the guide means 106, inhibits the reciprocating movement of the feed means 108.

The fastener carrier 106 is a square tubular member as of synthetic resin and supports a plurality of fastening elements 1, at regular intervals, in the vertical direction as viewed in the drawings. The fastener carrier 106 has equally spaced holes 110 made in its both sides panels and a marginal projection 111 projecting outwardly of its bottom panel at one side thereof.

A feed pawl 112 of the fastener feed means 108 is pivotally mounted, through a spring 117, on a pivot pin 118 which is mounted on a feed member 114 of a feed piston 115 which is reciprocatingly movable along an opening 113 made in one side panel of a supply passage (the guide means 107) for guiding the fastening element 1. When the feed piston 115 is manually advanced through a grip 104, the feed pawl 112 is engaged with one of the holes 110 of the fastener carrier 106 to move it forwardly, feeding the fastening element 1 to the predetermined position ahead of the drive rod 2 in preparation for the fastener driving operation. When the feed piston 115 is manually pulled back, since the rearward face of the feed pawl 112 is tapered as indicated 118, the feed pawl 112 is easily turned about the pivot pin 118 counterclockwise, as viewed in FIG. 11, getting out of engagement with the hole 110. When the feed piston 115 has been pulled back to its rearmost position, the feed pawl 112 is turned clockwise about the pivot pin 116 to snap into engagement with the next hole 110. In this case, the fastener carrier 106 is engaged with a check pawl 119 on the opposite side from the feed pawl 112 and is held stationary, and only the feed pawl 112 is moved back. As shown in FIG. 10, the check pawl 119 is hinged about a pin 105 and is biased by a coiled spring 102 to project into the fastener guide means 107. The check pawl 119 has a tapered rearward face 118 as shown in FIG. 11, and hence is retracted when the fastener carrier 106 is moved forward. The check pawl 119 normally engaged with the hole 110 to prevent backward movement of the fastener carrier 106.

Figure 12:
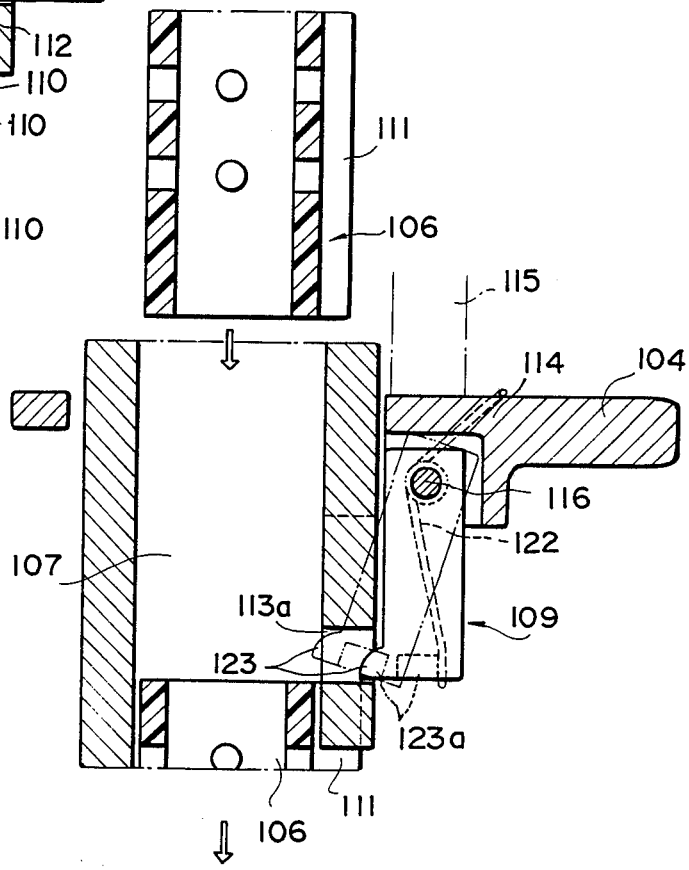

After the fastening elements 1 carried on the fastener carrier 106 have all been driven into a receiving material, the operation of the feed pawl 106 is inhibited by the lock means 109. The lock means 109 is provided with a pusher 123 which is pivotally mounted on the pin 116 at the extreme end of the feed piston 115 and is energized by a spring 122 as illustrated in FIG. 12. The pusher 123 is urged by the spring 122 against the side of the marginal projection 111 of the fastener carrier 106. When the last one of the fastening elements 1 has been driven into a receiving material, i.e. when the fastener carrier 106 has been brought to its foremost position, the pusher 123 gets out of pressing contact with marginal projection 111 of the fastener carrier 106 and the projection 123*a* formed under the pusher 123 is pushed by the spring 122 into the fastener guide means for 107 for engagement with a hole 113*a* made therein under the opening 113, locking the feed pawl 112. This ensures to eliminate the possibility of blank shooting by an accidental feed operation of the feed pawl 112 when the fastener carrier 106 is not loaded in the guide means 107. When the fastener carrier 106 is inserted again into the guide means 107, the lock means 109 is retracted.

In this way, the fastening element 1 is fed to the muzzle part 67 by moving the feed pawl 112 back and forth. In this case, since the front end portion of the safety valve 94 abuts against the pivot pin 116 of the feed means 108 as depicted in FIGS. 8(*a*) and (*b*), the safety valve 94 also operates in association with the fastener feeding operation described above. That is, when the feed pawl 112 is moved back after being brought to its forward position to feed the fastening element 1 to a predetermined position in the muzzle part 67, the safety valve 94 in contact with the pivot pin 116, as shown in FIG. 8(*b*), also retracted from the first position to the second position, making the tool A ready for the fastener driving operation in cooperation with the so-called contact operation. After each fastener driving work, the safety valve 94 is returned to the first position by release from its self-holding state and, at the same time, the feed pawl 112 is moved forward, so that the next fastening element 1 is also supplied to the muzzle part 67.

Referring now to the drawings, in particular, to FIGS. 8(*a*) and (*b*), the driving operation of the pneumatic tool A will be described as a whole.

The actuation of the pneumatic tool A starts with moving forward the feed means 108 of the fastener supply mechanism 80 to supply the fastening element 1 to the muzzle part 67 at a predetermined position therein. Then, the feed pawl 112 is moved back and the safety valve 94 is retracted from the first position to the second position. At this time, the safety valve 94 is connected to the expansion cylinder 91 of the contact member 68 to supply the output air from the former to the latter to expand it, extending the piston member 93 of the contact member 68.

At this stage, even if the trigger lever 69 is pulled, the pneumatic tool A would not be driven. The reason for this is as follows: Pulling the trigger lever 69, air is discharged from the trigger valve mechanism 70 and, at the same time, the air supplied via the safety valve 94 to the expansion cylinder 91 of the contact arm 92 is also discharged to release the safety valve 94 from its self-holding state. Consequently, the expansion cylinder 91 contracts and, accordingly, the contact member 68 also contracts to its initial state, making the pneumatic tool A inoperative.

When pressing the contact rod 92*a* of the contact arm 92 of the contact member 68 against a receiving material after the safety valve 94 has been retracted to the second position to expand the expansion cylinder 91, the extreme end of the piston member 93 pushes up the valve stem 85, moving down the pilot valve 81. This interrupts the communication between the pressure chamber 5 and the upper chamber 73 of the main valve cylinder but instead the trigger valve mechanism 70 is connected to the upper chamber 73 of the main valve cylinder, making the tool A ready for the fastener driving operation. When pulling the trigger lever 69 in this state, the air in the upper chamber 73 of the main valve cylinder is discharged from the trigger lever mechanism 70 and, at the same time, the main valve 71 is actuated to propel the drive rod 2, driving the fastening element 1 into a receiving material. Further, since the air in the expansion cylinder 91 of the contact arm 92, which is in communication with the trigger valve mechanism 70 through the safety valve 94, is also discharged in synchronism with the abovesaid discharge from the trigger valve mechanism 70, the expansion cylinder 91 contracts and the safety valve 94 is released from its self-holding state and moves forwards to the first position. At this time, the extreme end portion of the safety valve 94 pushes forwards the pin 116 of the fastener supply mechanism 80, supplying the next fastening element 1. Since the air supply to the expansion cylinder 91 of the contract arm 92 is interrupted, however, the pneumatic tool A is turned into the inoperative state, thus ensuring to prevent misshooting. Then, when releasing the trigger lever 69, the air in the pressure chamber 5 is supplied to the pilot valve 81 and the safety valve 94 through the trigger valve mechanism 70.

As described above, in order to activate the pilot valve 81, by the fastener shooting operation, for controlling the opening and closure of the main valve 71, it is necessary not only to press the contact member 68 against a receiving member but also to supply the output air from the safety valve 94 into the expansion cylinder 91 of the contact arm 92. Further, the safety valve 94 must be moved from the first position to the second position for supplying the air into the expansion cylinder 91. On the other hand, this movement takes place after making sure that the fastening element 1 has been fed to a predetermined position in the muzzle part 67, and the pneumatic tool A is released from its inoperative state to the operative state. This ensures effective prevention of blank shooting, too. In addition, by the fastener shooting operation, the safety valve 94 is released from its self-holding state at the second position and is moved forwards to the first position to make the pneumatic tool A inoperative, thus preventing blank shooting. This eliminates the possibility of the interior of the tool being damaged by blank shooting.

It will be apparent that many modifications and variations may be effected without departing from the scope of the novel concepts of the present invention.

What is claimed is:

1. A pneumatic tool used with an air supply source which supplies compressed air and having a manually operated trigger mechanism and a housing; and further comprising within the housing:

a drive rod for striking the fastening element to be driven into a receiving material;

a drive piston formed as a unitary structure with the drive rod;

a drive cylinder for housing the drive piston in a manner to be slidable therein;

a pressure chamber communicating with the drive cylinder;

a main valve mechanism disposed between the drive cylinder and the pressure chamber interrupting communication therebetween under the control of the trigger mechanism;

a pressure intensifier means provided between the pressure chamber and the air supply source for intensifying the pressure of the compressed air from the air supply source and for supplying the highly compressed air to the pressure chamber for storage from which the highly compressed air stored in the pressure chamber may be introduced into the drive cylinder to actuate the drive piston, the pressure intensifier means including a boost-up piston having a drive piston head of a large effective area and a compressing piston head of a small effective area interconnected by a boost-up piston rod, the drive piston head is reciprocably mounted within a large inside diameter cylinder and the compressing head is reciprocably mounted within a small diameter cylinder;

a timing valve positioned and shaped to be switched by the boost-up piston rod near the top and bottom dead centers of its stroke; and a change-over valve positioned and shaped to be actuated by a control air pressure based on the switching operation of the timing valve whereby air for driving the drive piston head will be repeatedly charged into and discharged from the large inside diameter cylinder by the operation of the change-over valve to automatically drive the boost-up piston reciprocatingly also driving the pressure intensifier means.

2. A pneumatic tool according to claim 1, further comprising a delay mechanism for limiting the flow quantity of air flowing into an air passage for actuating the change-over valve after the timing valve is switched at the top dead center of the piston rod.

3. A pneumatic tool according to claim 1 or 2, which further comprises a second valve stem having a face for receiving the highly compressed air from the pressure chamber and displaced by the pressure in the pressure chamber, a manually displaceable first valve stem, and a valve cylinder having housed therein the first and second valve stems in opposing relation, and wherein when the pressure in the pressure chamber has reached an arbitrarily settable pressure, an exhaust port of the pressure intensifier is closed by the cooperation of the first and second valve stems to stop the operation of the pressure intensifier.

4. A pneumatic tool according to claim 3, which further comprises a relief valve which is provided in an air passage between the pressure chamber and the atmosphere and is normally displaced to its closed position under the action of the compressed air from the air supply source and which, when the compressed air introduced from the air supply source is released to the atmosphere, is actuated to its open position under the action of the compressed air in the pressure chamber, discharging therefrom the highly compressed air.

5. A pneumatic tool according to claim 1, which further comprises a relief valve which is provided in an air passage between the pressure chamber and the atmosphere and is normally displaced to its closed position under the action of the compressed air from the air supply source and which, when the compressed air introduced from the air supply source is released to the atmosphere, is actuated to its open position under the action of the compressed air in the pressure chamber, discharging therefrom the highly compressed air.

* * * * *